United States Patent [19]

Chaillot

[11] 4,242,657

[45] Dec. 30, 1980

[54] ELECTRIC CONNECTOR

[76] Inventor: Gustave Chaillot, 8 rue Alsace Lorraine, 92 Boulogne sur Seine, France

[21] Appl. No.: 961,727

[22] Filed: Nov. 17, 1978

[30] Foreign Application Priority Data

Aug. 2, 1978 [FR] France ..... 78 22791

[51] Int. Cl.[3] ..... H01H 9/00; H01R 11/30; H01R 33/30

[52] U.S. Cl. ..... 335/207; 200/51.09; 335/205; 339/12 R

[58] Field of Search ..... 335/205, 207; 200/51.09, 51.1; 339/12 R

[56] References Cited

U.S. PATENT DOCUMENTS

| | | | |
|---|---|---|---|
| 3,159,725 | 12/1964 | Dennis | 200/51.09 |
| 3,202,783 | 8/1965 | Griesen | 335/205 |
| 3,816,679 | 6/1974 | Hotchkiss | 335/205 X |
| 3,868,160 | 2/1975 | Kersman | 200/51.09 X |

FOREIGN PATENT DOCUMENTS 2643031 3/1978 Fed. Rep. of Germany .

*Primary Examiner*—Fred L. Braun

*Attorney, Agent, or Firm*—Hubbell, Cohen, Stiefel & Gross

[57] ABSTRACT

An electric connector including, a female socket having at least one jack, a male plug assembly for coupling with the female socket and having a plug element thereby electrically engageable with the jack, a movable contact electrically connected to a terminal of the socket, the movable contact being mounted in the socket for movement between an operative position wherein the contact is electrically connected with the jack and an inoperative position wherein the contact is spaced from the jack and thereby not in electrical contact therewith, a magnetic actuator for moving the contact to the operative position upon the coupling of the male plug assembly to the female socket and a biasing magnet located in the socket for moving the contact to the inoperative position upon the uncoupling of the male plug assembly from the socket.

6 Claims, 5 Drawing Figures

ELECTRIC CONNECTOR

BACKGROUND OF THE INVENTION

1. Field of the Invention

This invention relates generally to electric safety connectors and in particular to such connectors which connect power to exposed terminals only after the parts of the connector are properly coupled.

2. Prior Art

It is well known that electric tapping sockets, as used in various applications, constitute a safety hazard in that improper contact therewith or connection thereto can cause a danger of electrocution. This hazard is particularly dangerous in domestic applications as young children, in their curiosity, can push items which may be electrically conductive, such as scissors or needles, into the common wall socket. In other uses, such as commercial and industrial, improper maintenance or care may also cause a danger of electrocution.

In response to these hazards, various attempts have been made to limit the danger of electrocution. One attempt includes a tapping socket having means for obturating the orifices of the socket. Normally the obturating means cannot be retracted unless the plugs of the corresponding connecting element are simultaneously introduced into the orifices. Unfortunately, with repeated use and the passage of time the obturating means often fail to operate properly and thereby loose their desired safety characteristics.

Another apparatus for reducing the danger of electrocution automatically interrupts power to the tapping socket when an improper grounding load is sensed at the connection terminals. Unfortunately this apparatus is complex in construction and high in cost making it unduely burdensome for small applications and domestic use.

Still another type of safety connector only connects power to the exposed terminals of the tapping socket after the two parts of the plug have been properly connected. This type normally includes a tapping socket having a pup jack or tip jack and a movable member mounted within the socket for connecting power to the jack. When the corresponding plug assembly is properly coupled to the tapping socket, a magnetic actuator moves the movable member from a safety position to a working position to connect power to the jack. When the plug assembly is removed from the socket, elastic biasing means returns the movable member to the safety position thereby disconnecting power from the jack. Unfortunately, this type of connector suffers from the problem that the elastic biasing means tends to fatigue with usage and age resulting in reduced effectiveness and eventually a total failure of the safety disconnect function.

SUMMARY OF THE INVENTION

An electric connector according to the present invention includes: a female tapping socket having at least one jack, a male plug assembly adapted for coupling to the female tapping socket and having a plug element thereby electrically engageable therewith, a movable contact element electrically connected by a flexible conductor to a connecting terminal of the tapping socket, the movable contact element being mounted in the tapping socket for movement between an operative position wherein the element is in electrical contact with the jack and an inoperative position wherein the element is spaced from the jack and thereby not in electrical contact therewith, magnetic actuating means for moving the movable contact element to the operative position upon the coupling of the male plug assembly to the female tapping socket, and magnetic biasing means located in the tapping socket for moving the movable contact element to the inoperative position upon the uncoupling of the male plug assembly from the tapping socket. The connector may include a movable member upon which the contact element is mounted, said movable member having first and second portions thereof made of substantially non-remanent magnetic material for attraction by the magnetic biasing means and the magnetic actuating means, respectively.

DETAILED DESCRIPTION OF THE PREFERRED EMBODIMENT

Figure 1:
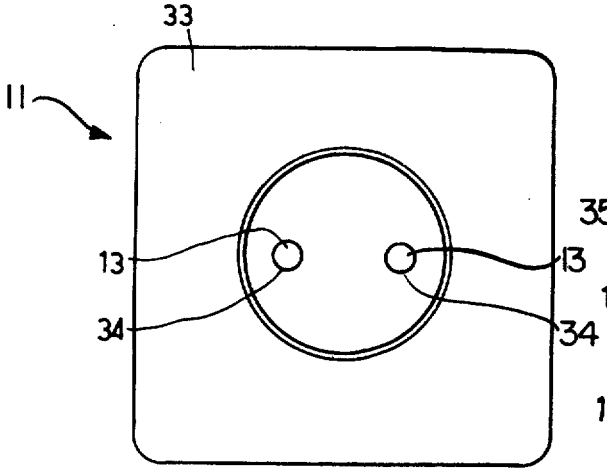
FIG. 1 shows a front view of a female socket according to one embodiment of the present invention.
Figure 2:
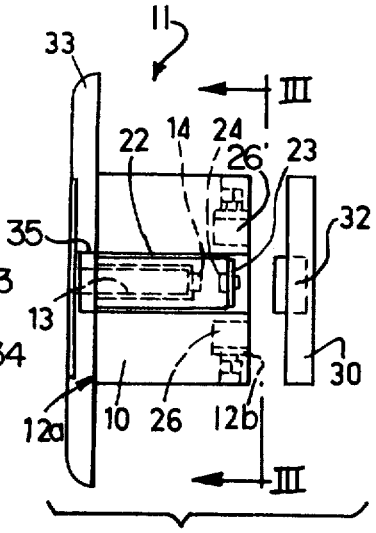
FIG. 2 shows a side view of the female socket of FIG. 1, partially disassembled.

One embodiment of the present invention includes a female tapping socket 11 as shown in FIGS. 1 and 2. The tapping socket 11 includes a cylindrical body 10 made of electrically insulating material and having a front surface 12*a* and a rear surface 12*b*. Any suitable structural insulating material may be used for the body 10 such as phenoplast or polyester compounds. Two jacks 13 in the form of metallic sleeves or pup jacks are mounted within the cylindrical body 10. Each jack 13 includes a contact element or stud 14 mounted at the rear end thereof.

The female tapping socket 11 also includes a front plate 33 mounted on the front surface 12*a* of the cylindrical body 10 and having circular holes 34 in register with the front opening of the jacks 13. The front plate 33 may be made of the same material as the cylindrical body 10. External connecting terminal 26 are mounted to the rear of the cylindrical body 10 for connecting electrical power to the tapping socket 11. A rear cover 30, made, like the cylindrical body 10, of electrically insulating material, is mounted to the rear surface 12*b* of the cylindrical body 10. The rear cover 30 mounts a biasing means in the form of a permanent magnet 32, the purpose of which is described below.

Figure 5:
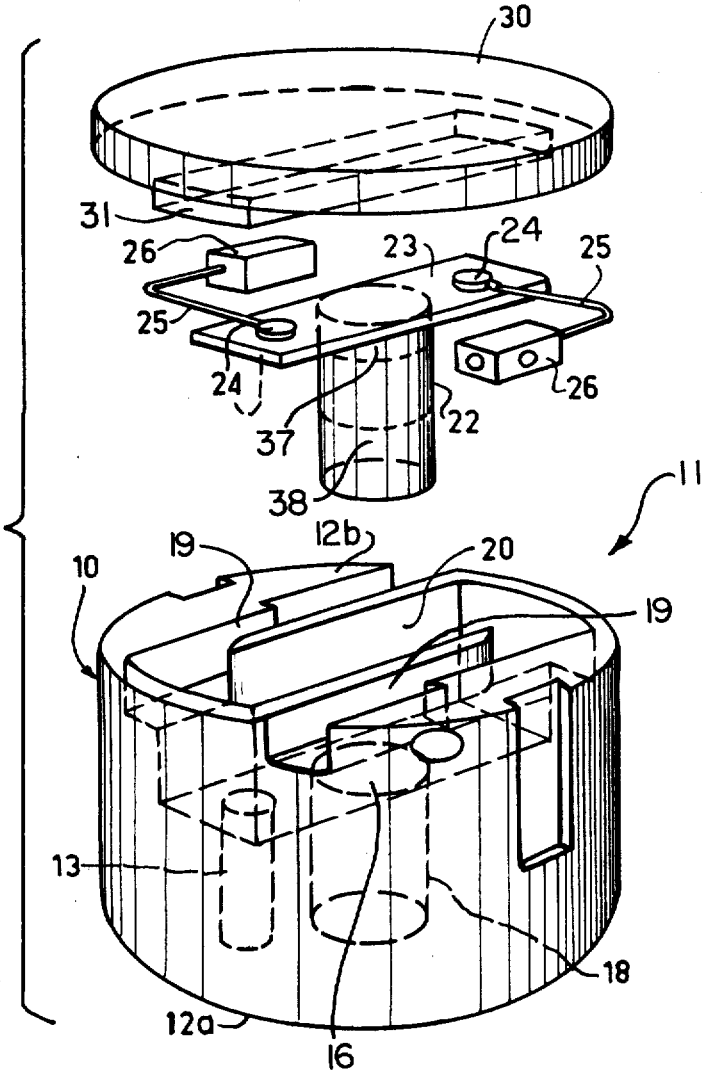
FIG. 5 shows an exploded perspective view of the female socket according to FIGS. 1-4.

The female tapping socket 11 is further described below with additional reference to FIG. 5. FIG. 5 shows the cylindrical body 10 having front surface 12*a* and rear surface 12*b* and one of the pup jacks 13 along with the rear cover 30. The cylindrical body 10 includes an axial bore 18 and a substantially parallel-epipedic recess 20 which are in connection with each other along the circular area 16. A cylindrical core 22, made of insulating material, is receivable within the axial bore 18. A substantially rectangular plate 23, also made of insulating material is mounted on one end of the cylindrical core 22 and is receivable in the recess 20 with the cylindrical core 22 located within the axial bore 18. The cylindrical core 22 and the plate 23 constitute a movable member upon which are mounted movable contact elements 24. The contact elements 24 penetrate the plate 23 as shown in FIG. 2. Flexible metallic strips or wires 25 connect the movable contact elements 24 to the external connecting terminals 26. The cylindrical body 10 includes channels 19 for mounting or receiving the flexible strips or wires 25 and the external connecting terminals 26. When the core 22, plate 23, strips 25 and terminals 26 are located within the respective bore 18, recess 20 and channels 19, the rear cover 30 may be affixed to the rear surface 12*b* of the cylindrical body 10. With the rear cover 30 so affixed, an extension 31 of the cover 30 is located within the recess 20.

Figure 3:
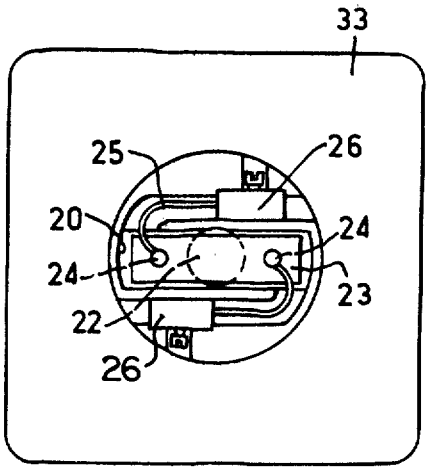
FIG. 3 shows a back view of a portion of the female socket of FIG. 2 taken along line III—III of FIG. 2.

FIG. 3 shows a rear view taken along line III—III of FIG. 2 showing the location of the core 22, plate 23, contacts 24, strips 25 and connectors 26 within the respective recesses of the cylindrical body 10.

Figure 4:
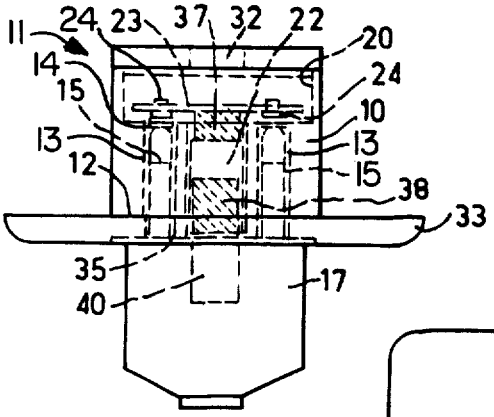
FIG. 4 shows a top view of the female socket of FIGS. 1-3 in combination with a male plug assembly according to one embodiment of the present invention.

FIG. 4 shows the female tapping socket 11 of FIGS. 1-3 and 5 coupled with a male plug assembly 17 in accordance with one embodiment of the present invention. The male plug assembly 17 includes plug elements 15 electrically engageable with the jacks 13 of the female socket 11. Also included in the plug assembly 17 is part of a magnetic actuating means in the form of a permanent magnet 40. Another part of this magnetic actuating means is constituted by a portion 38 of the core 22 which is made of a substantially non-remanent magnetic material such as soft iron. As shown, the portion 38 is located within the field of attraction of the permanent magnet 40. A second portion 37 of the core 22, also made of substantially non-remanent magnetic material is located within the field of attraction of the magnet 32 and thereby constitutes a part of the biasing means for the core 22. With the male plug assembly 17 coupled to the female socket 11, the portion 38 is located within the field of attraction of the permanent magnet 40 while the portion 37 is always within the field of attraction of the permanent magnet 32. The relative strengths of the permanent magnets are chosen so that the attraction of the core 22 by the permanent magnet 40 is stronger than the attraction of the core 22 by the permanent magnet 32 when the connector portions 11 and 17 are properly coupled.

In the preferred embodiment, both of the permanent magnets 32 and 40 should exhibit the magnetic quality of remanence and preferably should exhibit high remanence. By high remanence is meant remanence which will not be erased by the influence of other magnetic fields and the passage of time. Possible compositions for the permanent magnets 32 and 40 are iron-cobalt alloys such as 30% iron and 70% cobalt or 48% iron, 48% cobalt and 4% vanadium. Other possible compositions include maraging steel of 18% nickel, 9% cobalt, 5% molybdenum, 1% titanium and 67% iron. Likewise, other compositions exhibiting high magnetic remanence are also acceptable.

In FIG. 4 the core 22 is shown in its operative position in which the contact elements 24 are in electrical engagement with the contact studs 14 of the jacks 13. In this operative position, the portion 38 of the core 22 extends into a blind hole or recess 35 located in the side of the front cover 33 facing the cylindrical body 10. This operative position of the movable contact elements 24 is to be contrasted with the inoperative position of the contact elements 24 as shown in FIG. 2.

In operation, when the male plug assembly 17 is properly inserted into the female socket 11, the permanent magnet 40 attracts the second non-remanent portion 38 of the cylindrical core 22 to actuate movement of the movable contact elements 24 into contact and electrical connection with the contacts or studs 14 of the jack 13. Upon removal of the male plug assembly 17 from insertion in the female socket 11, the permanent magnet 32, which magnetically attracts the non-remanent portion 37 of the cylindrical core 22 to bias the cylindrical core 22 and the movable contact elements 24 to the inoperative position as shown in FIG. 2, causes the movement of the elements 24 to that inoperative position. Thus, when the male plug assembly is not inserted into the female socket 11, the movable contact elements 24 are maintained in their inoperative position as shown in FIG. 2.

According to the above arrangement, the insertion of an improper metallic or electrically conductive article, such as a pair of scissors or a paper clip in the hands of a child will not cause injury or a danger of electrocution, as the movable element 24 will be maintained in their inoperative position to prevent the connection of electricity to the jacks 13. This safety function is aided by the use of a substantially non-remanent magnetic material for the portion 38. The non-remanence of this material prevents its magnetization by long term magnetic engagement by the permanent magnet 40. Thus, the portion 38 will not attract itself to objects improperly inserted into the jacks 13 such as steel scissors or paper clips.

The effect of using a magnetic biasing means for maintaining the moveable contact elements 24 in their inoperative or safety position is that the operation of the safety function is not endangered by the failure of a mechanical biasing means. Further, the use of material exhibiting high magnetic remanence for both permanent magnets 32 and 40 also insures their long life and operability.

While the present invention has been described above in relation to the appended drawings, it will be obvious to one of ordinary skill in the art that various changes and modifications may be made therein without departing from the true scope of the invention. It should also be kept in mind that although the described function of the present invention is to promote safety the connector described in the appended claims may also be used in various other applications simply for the purpose of its switching function.

I claim:

1. An improved electric connector of the type including a female tapping socket having at least one jack, a male plug assembly for coupling to said tapping socket and having a plug element electrically engageable with said jack, a movable member having a contact element located thereon, said movable member being movably mounted in said tapping socket for movement between an operative position wherein said contact element is in electrical contact with said jack and an inoperative position wherein said contact element is spaced from said jack and thereby not in electrical contact therewith, terminal means located on said tapping socket for receiving electrical power, means for electrically connecting said terminal means to said contact element, magnetic actuating means for magnetically moving said movable member to said operative position upon the coupling of said plug assembly to said tapping socket and for magnetically holding said movable member in said operative position while said plug assembly and said tapping socket remain coupled, magnetic biasing means located in said tapping socket for magnetically moving said movable member to said inoperative position upon the uncoupling of said male plug assembly from said tapping socket, said movable member including magnetic material therein for attraction by said magnetic actuating means and said magnetic biasing means, wherein said improvement comprises said magnetic material being substantially non-remanent for preventing said magnetic material from being magnetized or becoming magnetized by prolonged magnetic influence from either said actuating means or said biasing means and thus being or becoming capable of moving said movable member to said operative position by magnetic attraction to any unmagnetized magnetic material in the vicinity of said tapping socket.

2. The improved connector of claim 1 wherein said biasing means includes a permanent magnet mounted in said tapping socket.

3. The improved connector according to claim 2, wherein said permanent magnet is a highly remanent rare-earth magnet for insuring long-term operation of said biasing means and the continued biasing of said movable member to its inoperative position.

4. The improved connector of claim 1 wherein said magnetic material is divided into a first portion for magnetic attraction by said actuating means and a second portion for magnetic attraction by said biasing means.

5. The improved connector of claim 1 wherein said actuating means includes a permanent magnet mounted on said male plug assembly.

6. The improved connector of claim 5 wherein said movable member is mounted for movement in opposite directions towards and away from said plug assembly when said plug assembly is coupled to said socket.

* * * * *